US011089882B2

(12) United States Patent
Faugno

(10) Patent No.: US 11,089,882 B2
(45) Date of Patent: Aug. 17, 2021

(54) SEATING AID

(71) Applicant: Rebecca S. Faugno, Escondido, CA (US)

(72) Inventor: Rebecca S. Faugno, Escondido, CA (US)

( * ) Notice: Subject to any disclaimer, the term of this patent is extended or adjusted under 35 U.S.C. 154(b) by 0 days.

(21) Appl. No.: 16/152,283

(22) Filed: Oct. 4, 2018

(65) Prior Publication Data

US 2019/0099013 A1 Apr. 4, 2019

Related U.S. Application Data

(60) Provisional application No. 62/568,247, filed on Oct. 4, 2017.

(51) Int. Cl.
*A47D 15/00* (2006.01)
*A47C 31/11* (2006.01)

(52) U.S. Cl.
CPC ..... *A47D 15/006* (2013.01); *A47C 31/11* (2013.01)

(58) Field of Classification Search
CPC ..... A47D 15/006; A47C 31/11
USPC ..... 297/284.9, 228.1
See application file for complete search history.

(56) References Cited

U.S. PATENT DOCUMENTS 3,506,988 A * 4/1970 Saddoris ..... A61G 7/05 5/411
3,515,430 A * 6/1970 Nelson ..... A47C 7/18 297/218.1
3,578,383 A * 5/1971 Earl ..... B60N 2/885 297/391
4,022,502 A * 5/1977 Smith ..... A47C 7/546 297/411.23
4,528,981 A * 7/1985 Behar ..... A61F 5/055 5/637
4,597,605 A * 7/1986 Gilbert ..... A47C 7/425 297/183.5
4,712,833 A * 12/1987 Swanson ..... A47D 1/004 297/219.12
4,725,094 A * 2/1988 Greer ..... A47C 31/02 297/188.06
5,056,533 A * 10/1991 Solano ..... A47D 15/006 128/876
5,367,730 A * 11/1994 Sher ..... A47D 13/08 5/632
5,584,422 A * 12/1996 Bond-Madsen ..... A47C 7/425 224/155
5,642,917 A * 7/1997 Geiger ..... A47D 1/103 297/219.12
6,644,747 B2 * 11/2003 Jones ..... B60N 2/2851 297/397

(Continued)

*Primary Examiner* — David R Dunn
*Assistant Examiner* — Tania Abraham
(74) *Attorney, Agent, or Firm* — Hunter Clark PLLC

(57) ABSTRACT

A seating aid includes: sensory input means for providing sensory input to a person while sitting on a seat, the sensory input means for resisting outward movement of thighs of the person while sitting on the seat; and attaching means for releasably attaching the sensory input means to the seat such that the sensory input means will be disposed above the seat; where the seating aid is configured to allow, with the seating aid disposed on the seat, the person either to sit directly on the seat or to sit on a flexible material of the seating aid that is overlying and in contact with the seat.

13 Claims, 5 Drawing Sheets

(56) References Cited

U.S. PATENT DOCUMENTS

| | | | | |
|---|---|---|---|---|
| 6,764,134 | B1 * | 7/2004 | Crescenzi | A47C 31/00 2/69 |
| 6,802,563 | B1 * | 10/2004 | Mysliwiec | B60N 2/99 297/284.9 |
| 7,261,380 | B2 * | 8/2007 | Ha | A61H 1/006 297/219.1 |
| D670,122 | S * | 11/2012 | Childress | D6/601 |
| 9,237,812 | B1 * | 1/2016 | Cordell | A47C 7/425 |
| 9,420,898 | B2 * | 8/2016 | Schechtman | D06Q 1/00 |
| 9,433,298 | B2 * | 9/2016 | Bryer | A47C 7/021 |
| 2009/0284056 | A1 * | 11/2009 | Chico | A47C 31/113 297/228.1 |
| 2014/0115787 | A1 * | 5/2014 | Garcia | A47G 9/10 5/636 |
| 2017/0245655 | A1 * | 8/2017 | Satmary | A47C 31/11 |
| 2017/0290441 | A1 * | 10/2017 | Whitted | A47C 31/11 |

* cited by examiner

SEATING AID

CROSS-REFERENCE TO RELATED APPLICATIONS

This application claims the benefit of U.S. Provisional Application No. 62/568,247, filed Oct. 4, 2017, entitled "HIP HUGGER SEAT COVER," the entire contents of which are hereby incorporated herein by reference for all purposes.

BACKGROUND

Some persons, especially children, have difficulty sitting still for even small periods of time. For example, a child may not be able to sit in a standard position, with thighs on a seat, facing forward, for enough time to complete task (e.g., eat a meal, perform school work) or to hear a lesson from a teacher. Persons may move, and move frequently, to various positions such as sitting on the edge of a seat, sitting with legs hanging off a side of the seat (instead of the front of the seat), sitting on their legs or feet, sitting with a small portion of their gluteus maximus on the seat, etc. If the person shifts to different positions, this may hinder the person's ability to focus or complete a task, and may cause a disruption, e.g., causing others nearby to be distracted by the fidgeting person such as causing other students to lose focus and potentially miss information presented by a teacher.

Persons may not be able to sit still for a variety of reasons. For example, persons with special needs such as those that have attention deficit hyperactivity disorder (ADHD) may find it difficult to sit still. As another example, persons with autism (even mild forms of autism at one end of the autism spectrum) may also struggle with remaining seated, at least in the standard position, for expected amounts of time. As yet another example, a person may have a proximal stability weakness stemming from the person's hip area. A person with a neurological issue that moves frequently may be seeking sensory input, e.g., from nearby objects such as a desk, a table, chair legs, a floor, other persons, etc.

SUMMARY

An example of a seating aid includes: sensory input means for providing sensory input to a person while sitting on a seat, the sensory input means for resisting outward movement of thighs of the person while sitting on the seat; and attaching means for releasably attaching the sensory input means to the seat such that the sensory input means will be disposed above the seat; where the seating aid is configured to allow, with the seating aid disposed on the seat, the person either to sit directly on the seat or to sit on a flexible material of the seating aid that is overlying and in contact with the seat.

Implementations of such a seating aid may include one or more of the following features. The seating aid may include retaining means for retaining a first barrier of the sensory input means and a second barrier of the sensory input means in respective positions relative to the seat. The attaching means may include the retaining means. The retaining means comprise a fabric sheet extending between the first barrier and the second barrier. The attaching means are for slidably receiving a back of a chair comprising the seat.

An example of a device for use with a seat includes: a first side guard; a second side guard; a separator coupled to the first side guard and the second side guard; an attachment mechanism connected to the separator, or connected to the first side guard and the second side guard, or connected to the separator, the first side guard, and the second side guard, the attachment mechanism being configured to releasably attach the device to the seat such that, when the device is attached to the seat, the first side guard provides a first lateral impediment along a first front-to-back distance of the seat and the second side guard provides a second lateral impediment along a second front-to-back distance of the seat; where the separator, or the attachment mechanism, or a combination thereof, is configured to inhibit separation of the first side guard from the second side guard with the device attached to the seat by the attachment mechanism; where each of the first side guard and the second side guard, with the device attached to the seat, will be disposed above a surface of the seat to interfere with a lateral movement of a respective leg of a user sitting on the seat; and where the device is configured such that, with the device attached to the seat, the device: provides an aperture between the first side guard and the second side guard through which a person can sit directly on the seat; or comprises a flexible sheet between the first side guard and the second side guard.

Implementations of such a device may include one or more of the following features. The attachment mechanism includes a flexible line attached to first side guard and the separator comprises a flexible material attached to the first side guard and the second side guard. The attachment mechanism includes a plurality of flexibles lines each attached to the first side guard or the second side guard. Each of the first side guard and the second side guard extend at a respective oblique angle relative to a front-to-back direction of the seat.

An example of a seat cover includes: a fabric sheet; a first lateral impediment attached to and disposed along a first length of the fabric sheet, the first lateral impediment extending away from the fabric sheet; a second lateral impediment attached to and disposed along a second length of the fabric sheet, the first length being laterally displaced from the second length; and a fastener attached to the fabric sheet, or attached to the first lateral impediment and the second lateral impediment, or attached to the fabric sheet and the first lateral impediment and the second lateral impediment, and configured to removably fasten the seat cover to a seat; where the first lateral impediment and the second lateral impediment extend away from the fabric sheet and away from a top surface of the seat when the seat cover is fastened to the seat to receive a person on the fabric sheet.

Implementations of such a seat cover may include one or more of the following features. The seat cover may include a tubular back attached to the fabric sheet and configured to removably receive a back of a chair. The tubular back includes a fabric tube. The tubular back and the fabric sheet comprise different fabrics. The fastener includes a first pair of fabric straps and a second pair of fabric straps displaced from the first pair of fabric straps along a front-to-back distance of the seat cover. The first lateral impediment and the second lateral impediment each include a resilient member disposed in a fabric tube. Each of the first lateral impediment and the second lateral impediment extends at a respective oblique angle relative to a front-to-back direction of the seat cover.

DETAILED DESCRIPTION

Techniques are discussed herein for providing seating guidance to a person sitting on a seat, e.g., of a chair, stool, etc. For example, a device may be removably placed on and attached to a seat, and may provide a barrier on each side of a person's legs while sitting on the seat. The barriers may provide tactile and proprioceptive input to the person so that the person is cued as to where the person's legs belong, e.g., for a desirable and functional learning posture in a chair. An example chair cover has a back portion and a set portion. The back portion may be a fabric tube that fits over (e.g., slides over, or can be wrapped around and secured) a back of a chair. The seat portion can be fastened to the chair and provides raised leg guides that resist outward movement or excess abduction of the person's thighs. The guides may provide sensory input to the person, e.g., proprioceptive, vestibular, and/or tactile input to the person. These examples, however, are not exhaustive.

Items and/or techniques described herein may provide one or more of the following capabilities, as well as other capabilities not mentioned. Proprioceptive, vestibular, and/or tactile input may be provided to a person sitting on a seat (e.g., of a chair, stool, etc.). A seating aid may provide guides to indicate to a person where the person's thigh or thighs belong for a desired, e.g., a learning-ready, sitting position. Focus and attention of seated person's may be extended. Proper posture while seated may be encouraged. A time duration that a person is able to sit may be extended. Fidgeting of a person while seated may be reduced. Desired (e.g., appropriate, functional, and/or expected) sitting positions may be encouraged. Undesired sitting positions (e.g., side sitting, sitting on a person's legs or feet, sitting on an edge of a seat, sitting with an undesirably small amount of a person's gluteus maximus on a seat, etc.) may be passively discouraged by a mechanical seating aid. Person's with ADHD, autism, and/or ADD (attention deficit disorder) may be able to sit for longer periods of time and/or with greater focus, e.g., due to being passively reminded to stay in a more stable position on a seat with decreased prompt dependency from another person. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect.

Figure 1:
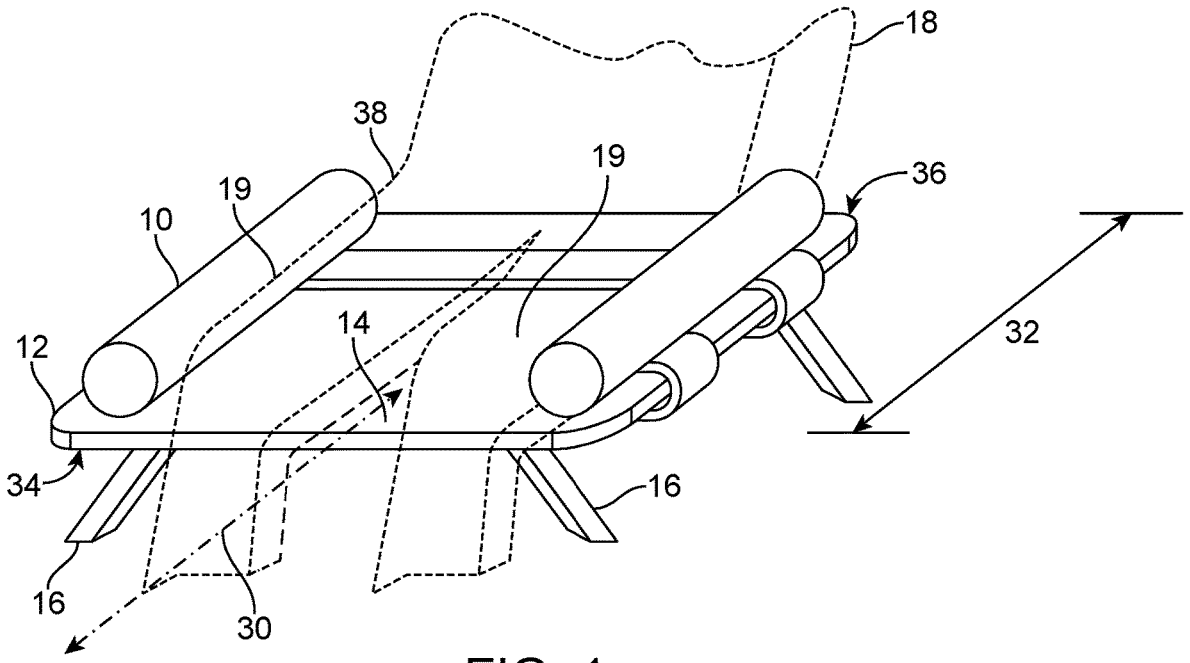
FIG. 1 is a top perspective view of a seating aid, a seat, and a person sitting on the sitting aid and the seat.
Figure 2:
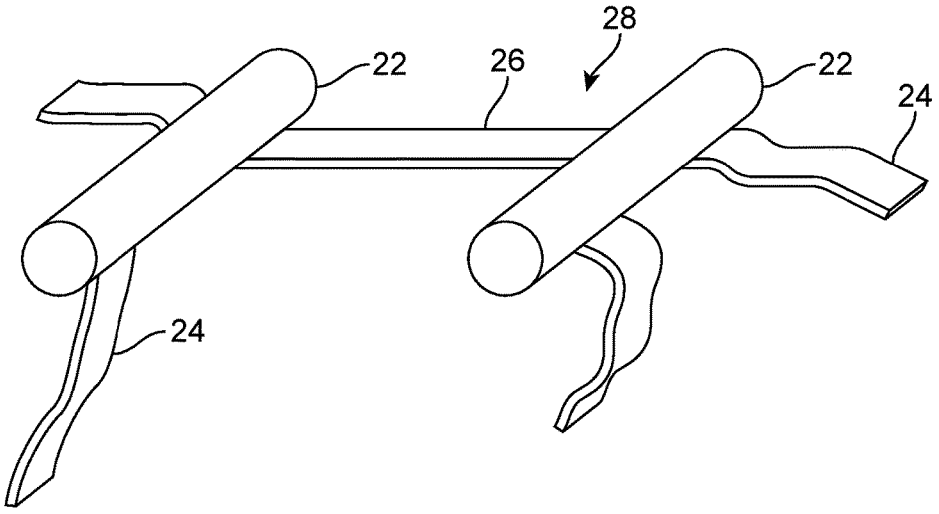
FIG. 2 is a top perspective view of the seating aid shown in FIG. 1.

Referring to FIGS. 1 and 2, a seating aid 10 is configured to be removably attached to a furniture item 12. Here, the seating aid 10 is attached to a seat 14 of the furniture item 12. The furniture item 12 in this example is a stool, having the seat 14 and legs 16 (portions of three of which are shown in FIG. 1), although the seating aid 10 may be used with other types of furniture items, e.g., chairs, etc. The seating aid 10 is configured to provide sensory input to a person 18 sitting on the seat 14. In particular, the seating aid 10 is configured to provide resistance to outward movement of thighs 20 and/or abduction of hips 38 of the person 18. The seating aid 10 includes barriers 22, an attachment mechanism (here, attaching straps 24), and a separator 26. The seating aid 10 is configured to provide an aperture 28 when attached to the furniture item 12 to allow the person 18 to sit on the seat 14, here in direct contact with the seat 14 except for where the separator 26 separates the person 18 from the seat 14.

The barriers 22 are configured and disposed to provide guides to the person 18. The barriers 22 may be called guides, or rails, or bumpers, or lateral movement impediments, etc. The barriers 22 may provide sensory input to the person 18, e.g., to help direct or cue the person 18 to a desired sitting position. Also or alternatively, the barriers 22 may provide proprioceptive input to the person to help the person appreciate an orientation of the person (e.g., help provide stability guidance to the person 18). Also or alternatively, the barriers 22 may provide proprioceptive input to help the person 18 understand the person's sense of relative position (e.g., with respect to the furniture item 14, with respect to the earth, etc.).

The barriers 22 are sized to interfere with and/or impede abduction of the thighs 19 outwardly from a midline of the person 18. For example, the barriers 22 may be configured to extend at least about two inches (2 in.) (about five centimeters, 5 cm) above the seat 14 when the seating aid 10 is disposed on the seat 14. The barriers 22 may be configured to extend other distances from the seat 14, e.g., at least about 4 in. (10 cm), at least about 10 in. (25 cm), at least about 11 in. (27.5 cm), at least about 12 in. (30 cm), etc. Other sizes (e.g., heights) of barriers 22 may be used. Also, the barriers 22 may extend approximately parallel (e.g., parallel ±10°) to a centerline 30 of the furniture item 12 when attached to the furniture item 12, and/or may extend approximately perpendicular (e.g., perpendicular ±10°) to a length of the separator 26. The barriers 22 may extend over a significant portion (e.g., 50% or more) of a front-to-back length 32 of the seat 14. The barriers 22 may extend over a length near a front 34 of the seat 14, while not extending close to a back 36 of the seat 14, e.g., where the hips 38 of the person 18 are preferably disposed.

The barriers 22 may be disposed, when attached to the furniture item 14 to allow the person 18 to move while providing resistance to abduction of one or more of the thighs 19. The separator 26 may be of a length such that with the barriers 22 separated by the length of the separator 26, the aperture 28 is wide enough to accommodate the thighs 19 and the hips 38 of the person 18 while being disposed to provide lateral impediments to the person 18. The barriers 22 may be disposed such that barriers 22 will be in contact with the person 18 without abduction of the thighs 19, or with slight abduction of the thighs 19. For example, for use with preschool children, the seating aid 10 may be configured such that barriers 22 are separated by about 12 in. (30 cm). For use with children from first to fourth grade, the seating aid 10 may be configured such that barriers 22 are separated by about 13.5 in. (34 cm). For use with children in fifth or sixth grade and beyond, the seating aid 10 may be configured such that barriers 22 are separated by about 15 in. (38 cm). The barriers 22 may be disposed to provide tactile input to the person 18 as the person moves laterally, i.e., side to side on the seat 14. The barriers 22 may be disposed proximate to at least a portion of a perimeter of the seat 14.

The barriers 22 may comprise one or more materials such that the barriers 22 are resilient, durable, and resistant to fraying or otherwise being easily picked apart. For example, the barriers 22 may be made of a durable rubber or foam that is not easily torn. Persons with autism, ADHD, and/or ADD may pick at the barriers 22 but the material of the barriers 22 makes picking at the barriers difficult. For example, each of the barriers 22 may comprise a fabric (e.g., cloth) tube with a rubber or other resilient material disposed in the tube.

The separator 26 may be configured to help ensure a desired separation of the barriers 22. The length of the separator 26 used may be selected to help guide the person 18. For example, the length of the separator 26 used may have the barriers 22 hug (e.g., touching and biased against) the hips 38 of the person 18 without movement of the person on the seat 14. The length of the separator 26 used may have the barriers 22 touching the thighs 19 of the person 18 before abduction of the thighs 19, or may provide a space between the barriers 22 and the thighs 19 to allow for some abduction (e.g., an angular separation of the thighs 19 of 10°) before contact with at least one of the barriers 22).

The separator 26 may be configured to facilitate the person 18 sitting on the seat 14. For example, the separator 26 may be made of a flexible material, e.g., a strap of woven nylon, to allow the separator to adjust to one or more contours of the seat 14, e.g., under the weight of the person 18. The separator 26 may be a durable, yet flexible material. Alternatively, the separator 26 may be a rigid material, e.g., a strip of plastic, to help ensure the separation of the barriers 22 and to retain the separation of the barriers 22 at the length of the separator 26. The separator 26 may be thin, e.g., less than half an inch (1.25 cm), less than a tenth of an inch (0.25 cm), etc. This may facilitate the person 18 sitting on the seat 14 without adding significant height to the seat 14 while being comfortable for the person 18. In other example implementations, one or more additional separators may be included as part of the seating aid 10.

The attaching straps 24 are one form of an attachment mechanism configured to releasably attach the seating aid 10 to the furniture item 12. In this example, the attaching straps 24 are adjustable straps of material that may be fastened to each other and/or to the furniture item (e.g., buckled or fastened to the furniture item 12 or to each other under the seat 14), although other forms of fastening, e.g., depending upon the type of attaching mechanism, may be employed. The attaching straps 24 are configured to secure the seating aid 10 to the furniture item 12 so that the barriers 22 will be substantially fixed, being able to resist outward movement (i.e., away from the centerline 30) by the person 18. The barriers 22 may be able to move while the seating aid is attached to the furniture item 12, but are inhibited from moving such that the barriers 22 provide tactile input to the person 18 pushing against one or both of the barriers 22. The attaching straps 24 are attached at different points along lengths of the barriers 22 to help inhibit pivoting of the barriers 22. The attaching straps 24 are configured and disposed to secure the seating aid 10 to the furniture item 12 to inhibit lateral, side-to-side, movement of the seating aid 10 relative to the seat 14. The attaching straps 24 may inhibit front-to-back (or vice versa) movement (e.g., parallel to the centerline 30). Additional attaching straps (e.g., see FIG. 5) and/or one or more other features (e.g., see FIG. 6) may be included as part of the seating aid 10 to inhibit front-to-back (or vice versa) movement of the seating aid 10 relative to the seat 14. The attaching straps 24 in conjunction with the separator 26 is configured to secure the barriers 22 above the seat 14 such that the barriers 22 are disposed and held in place to provide abduction resistance to the thighs 19. For example, the attaching straps can be affixed to the furniture item 12 and/or each other and tightened such that the separator 26 is taut. The barriers 22 will thus be separated by the length of the separator 26, retained at this distance by the separator 26, and held in place to resist lateral movement by the person 18 to provide sensory input to the person in response to the person 18 moving one or more of the thighs 19 outward and/or moving one of the hips 38 away from the centerline 30.

Figure 3:
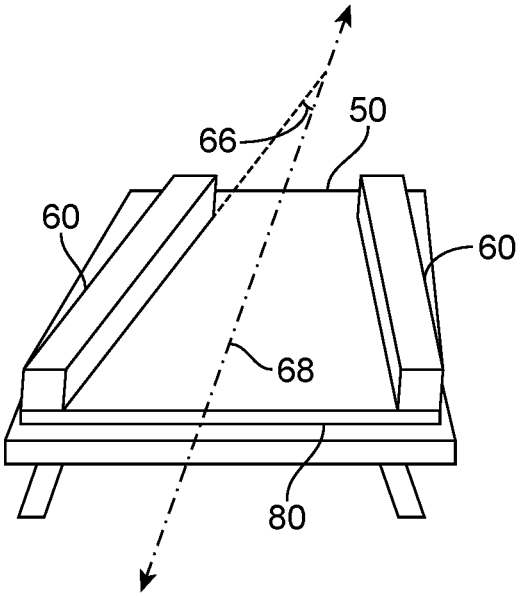
FIG. 3 is a top perspective view of another seating aid, with barriers at oblique angles relative to a centerline of the seating aid.
Figure 4:
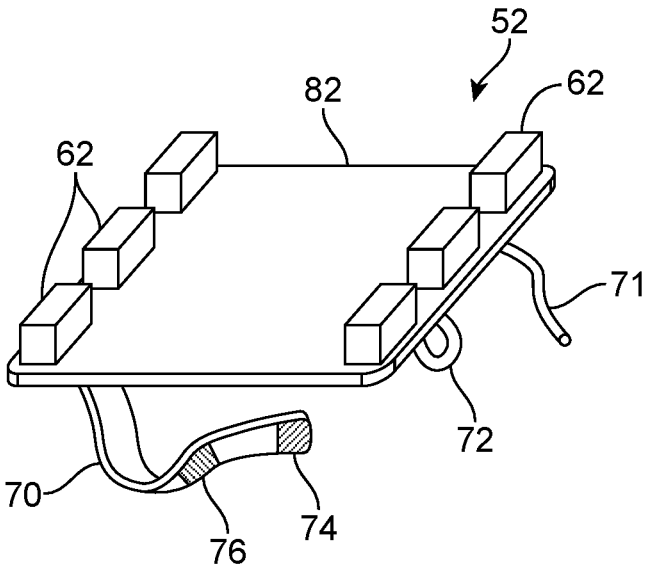
FIG. 4 is a top perspective view of another seating aid, with discontinuous lateral barriers.
Figure 5:
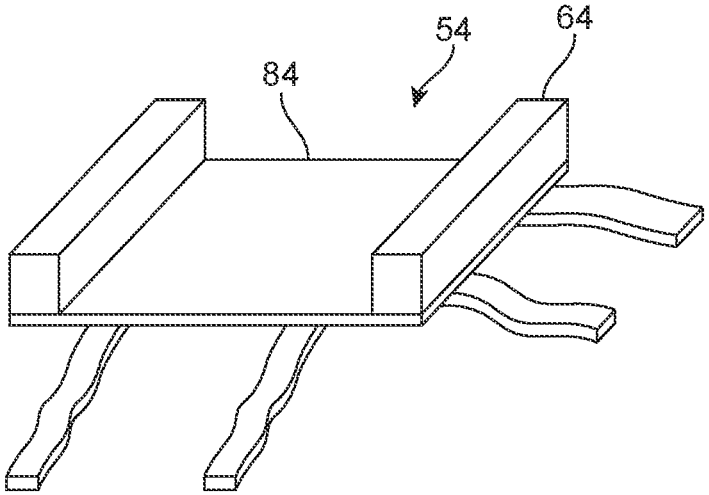
FIG. 5 is a top perspective view of another seating aid, with alternative barrier cross-sections and an alternative attachment mechanism.
Figure 6:
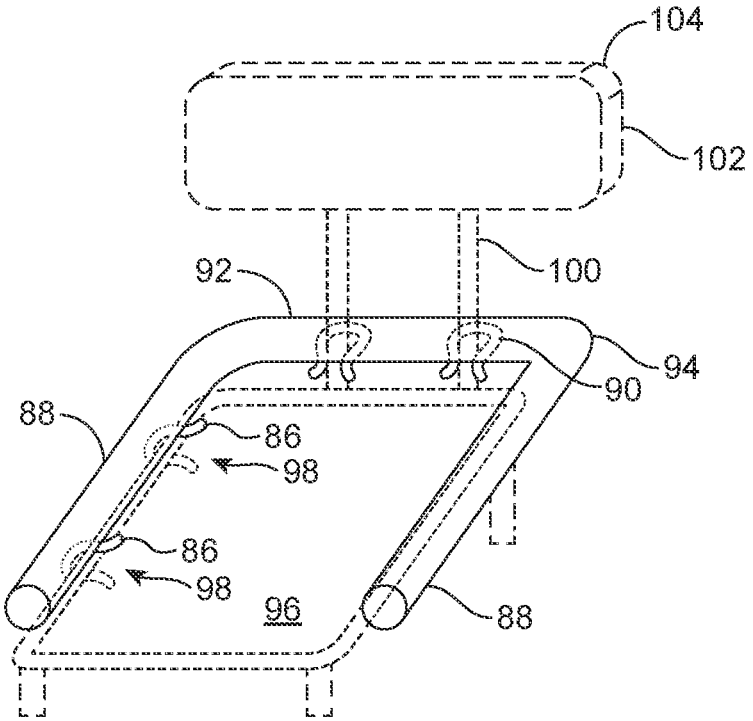
FIG. 6 is a top perspective view of another seating aid, with alternative shape and an alternative attachment mechanism.
Figure 7:
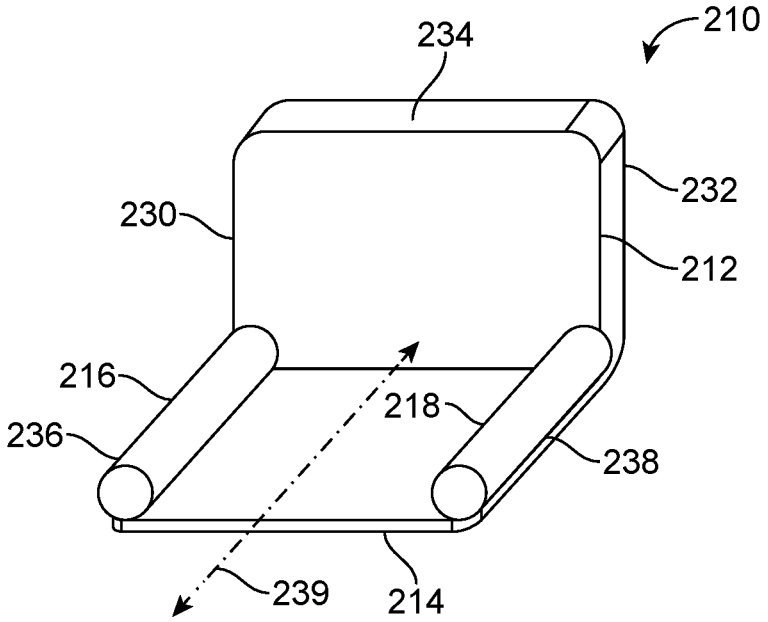
FIG. 7 is a top perspective view of another seating aid, configured as a chair cover.
Figure 8:
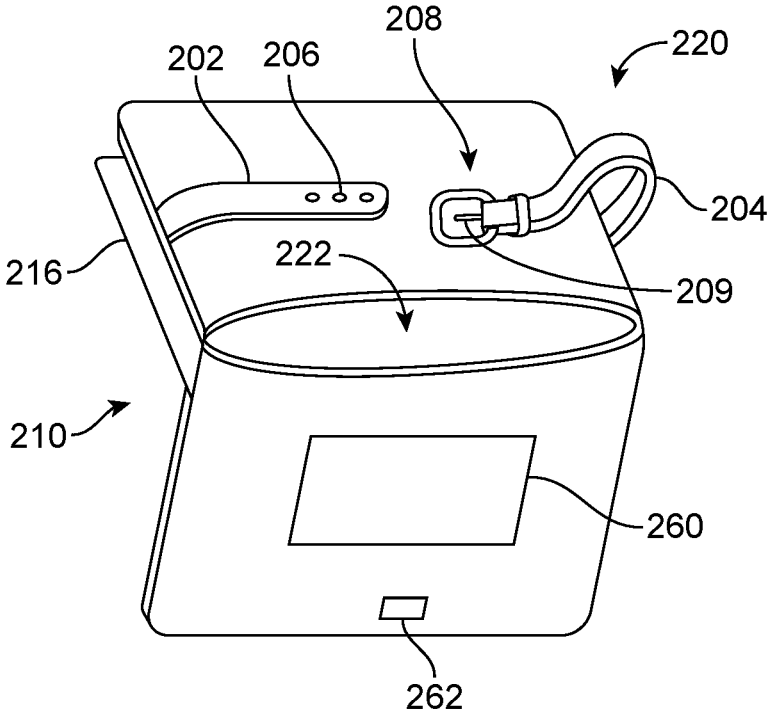
FIG. 8 is a bottom perspective view of the seating aid shown in FIG. 7.

The seating aid 10 as shown in FIGS. 1 and 2 is an example only, and many other configurations of seating aids may be used. For example, seating aids with barriers of a variety of different shapes (i.e., differently-shaped barriers) may be used. In FIGS. 1 and 2, the barriers 22 have cylindrical shapes, with circular cross-sections. The barriers 22 thus extend away from the separator 26 (e.g., away from the seat 14) and toward the centerline of the seating aid 10 for the lower halves of the heights of the barriers 22 and away from the separator 26 and away from the centerline for the upper halves of the heights of the barriers 22. Referring to FIGS. 3-5, for example, seating aids 50, 52, 54 with barriers 60, 62, 64, respectively, with rectangular (e.g., square) cross-sections may be used. The barriers 60, 62, 64 extend substantially vertically away from separators 80, 82, 84 (e.g., within 10° of perpendicular to planes of the respective separators 80, 82, 84 when taut). Still other shapes (e.g., triangles, ovals, etc.) may be used.

Other examples of barriers may be used in various configurations of seating aids. For example, while the barriers 22 shown in FIGS. 1 and 2 are monolithic, non-monolithic barriers may be used such as the barriers 62 that comprise multiple, separated, portions. As yet another example, barriers may extend at oblique angles relative to a centerline of a seating aid. For example, referring to FIG. 3, the barriers 60 extend at plus or minus an angle 66 relative to a centerline 68 of the seating aid 50. The angle 66 may be, for example, about 10° (e.g., 10°±2°), or about 15°, or about 20°, or another angle. In this way, the barriers 60 may be closer to the person's hips than to lower ends of the person's thighs or the person's knees as it may be desirable to restrict movement of the person's hips more than the lower ends of the person's thighs.

Also or alternatively, various other types of attaching mechanisms may be used. For example, different forms of attachment mechanisms may be used. Referring to FIG. 4, for example, one or more attachment cords (or ropes) 71 may be used instead of or in addition to straps. Many other forms of attachment mechanisms may be used such as pairs of straps with buttons, snaps, or belt buckles to secure the straps to each other. For example, one or more pairs of nylon straps with each strap in a pair terminating with a mating portion of a side-release or quick-release buckle. Still other examples of attachment mechanisms include, referring to FIG. 4, a strap 70 and a loop 72 configured such that the strap 70 can be fed through the loop 72 and a first portion 74 of the strap 70 attached to a second portion 76 of the strap 70. For example, the first portion 74 may include hooks and the second portion 76 may include loops such that the first and second portions 74, 76 are parts of a hook-and-loop fastening mechanism. Other configurations may be used, such as the portions 74, 76 including halves of snaps, or a button and button holes, respectively, etc. More than one of the strap-and-loop combinations may be used (e.g., one or more for attaching the seating aid side-to-side to a seat and/or one or more for attaching the seating aid front-to-back to the seat). As another example attachment mechanism configuration, referring to FIG. 6, clips 86 may be attached to bottoms of barriers 88 and clips 90 may be attached to a separator 92 of a seating aid 94. The seating aid 94 is a U-shaped, rigid device although the barriers 88 may have a pliable outer surface. The clips 86 are configured to receive a seat 96 in apertures 98. The clips 90 are configured to receive posts 100, that extend from the seat 96 to a back rest 102 of a chair 104, by pushing the seating aid 94 onto the posts 100 from a back of the chair 104 (such that the separator 92 is disposed behind the posts 100). The clips 86, 90 may releasably attach the seating aid 94 to a chair 104. The clips 86 may be configured to position the barriers 88 above the seat 96. Alternatively, the clips 86 may not be used and the clips 90 may be used to position the barriers 88 above the seat 96.

In addition to the attaching mechanism, one or more other features may be provided to help inhibit lateral motion of a seating aid (or at least lateral impediments of seating aids) relative to a seat. For example, slip-resistant material may be disposed on one or more surfaces configured to contact the seat, e.g., on a bottom of a seating aid, and/or on one or more surfaces of an attaching mechanism to help inhibit detaching of a seating aid once attached to a seat. For example, a slip-resistant sheet and/or slip-resistant patches may be disposed on a bottom of a seating aid.

Still other configurations of seating aids may be used. For example, attachment mechanisms, separators, and/or barriers discussed, in addition to others not discussed, may be mixed and matched to form other seating aid configurations.

Referring to FIGS. 7-10, a seating aid 210 includes a back 212, a base 214, lateral impediments 216, 218, and an attachment mechanism 220. The seating aid 210, in this example, is configured as a seat cover, and in particular a chair cover. The seating aid 210 may omit the back 212.

Figure 9:
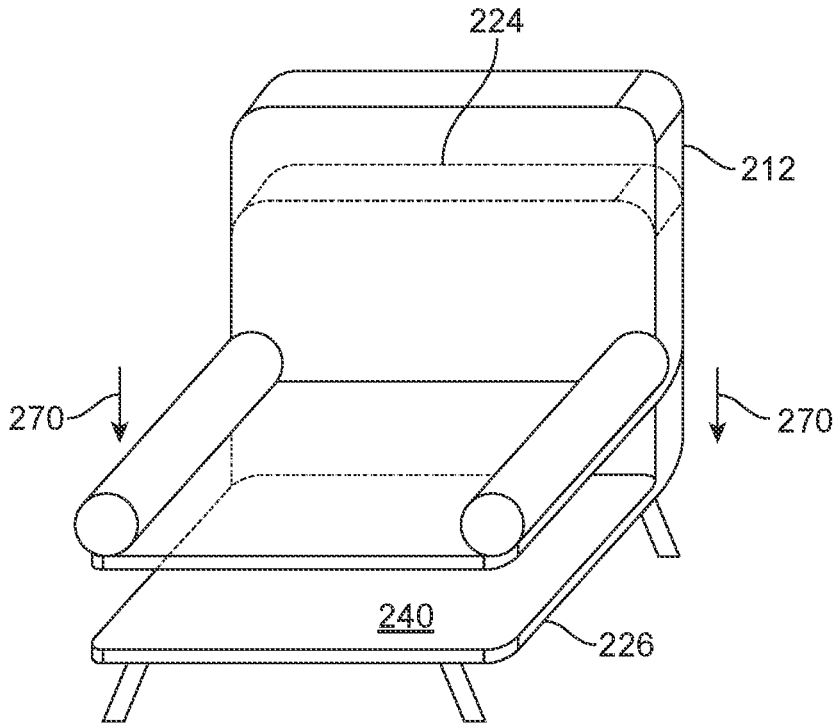
FIG. 9 is a top perspective view of the seating aid shown in FIG. 7 partially receiving a chair.

The back 212 comprises a tubular sheath providing an opening 222 configured to receive a back 224 of a chair 226 (see FIG. 9). The back 212 may be configured such that the opening 222 is close to a size of the back 224 of the chair 226 such that the seating aid will snugly receive the back 224 to help retain the seating aid 210 in place relative to the chair 226 with the back 224 received by the opening 222. The back 212 of the seating aid 210 may be a fabric sheet folded over and sewn onto itself along sides 230, 232 of the back 212 to provide the opening 222.

Alternatively, one or more of the sides 230, 232 may be opened and closed, e.g., by a respective zipper. A height of the back 212 may be such that the back 212 may fully receive the back 224 of the chair 226. A top 234 of the back 212 may be closed, providing a fixed maximum depth of the back 212. Alternatively, the top 234 of the back 212 may be open, or selectively opened (e.g., with a zipper) such that chairs with backs taller than the height of the back 212 of the seating aid 210 may be accommodated (e.g., extend out the top 234 of the back 212 of the seating aid 210).

The lateral impediments 216, 218 may be tubes 236, 238 of fabric, e.g., the same fabric used for the back 212, with elongated members disposed within the tubes. For example, foam or rubber tubes or cylinders may be used as the elongated members and disposed in the 236, 238. The tubes 236, 238 may be sewn shut. Alternatively, each of the tubes 236, 238 may be openable on at least one end such that the tube may be opened to remove or insert the elongated member, and closed (e.g., by being buttoned or snapped or zipped shut). The tubes 236, 238 may be sewn or otherwise attached to the back 212. The base 214 may be a sheet of fabric, e.g., the same fabric used for the back 212. The base 214 is attached to the back 212, and the back 212 and the base 214 may be formed from a single, monolithic sheet of fabric. The base 214 may be attached, e.g., sewn, to the lateral impediments 216, 218. The base 214 may be resistant to stretching such that the base, attached to the lateral impediments 216, 218 is configured to inhibit lateral motion of the lateral impediments away from a centerline 239 of the seating aid 210 with the base 214 pulled taut by the attachment mechanism 220. The base 214 has a small (e.g., not a significant) thickness such that the base 214 does not significantly raise a person sitting on the seating aid 210, when disposed on the chair 226, compared to the person directly sitting on the chair 226. For example, the base 214 may have a thickness of less than about a quarter of an inch (about 0.6 cm) or less than about 0.1 inches (about 0.25 cm).

Figure 10:
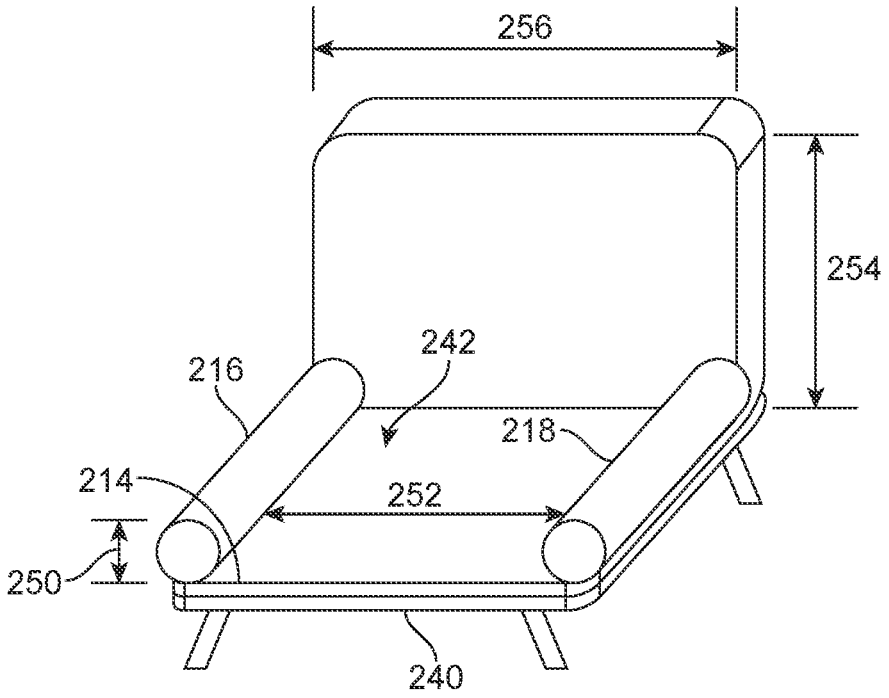
FIG. 10 is a top perspective view of the seating aid shown in FIG. 7 fully receiving a chair.

The attachment mechanism 220 is configured to releasably attach the seating aid 210 to the chair 226, and to pull the base 214 taut, to inhibit movement of the seating aid 210 relative to the chair 226 and thus to inhibit lateral movement of the lateral impediments 216, 218 from outward (side-to-side) lateral movement. The attachment mechanism 220 comprises a buckle arrangement including a pair of straps 202, 204 although more than one pair of straps may be used and/or other types of attachments mechanisms may be used. Here, the straps 202, 204 are configured to attach by a buckle arrangement, with the strap 202 providing holes 206 and the strap 204 including a buckle 208 affixed at an end of the strap 204 and configured to have the strap 202 passed through the buckle 208 and a pin 209 of the buckle 208 inserted through a respective one of the holes 206. One or more additional mechanisms, e.g., one or more additional buckle configurations could be attached to the base 214 to inhibit front-to-back motion of the seating aid 210 relative to the chair 226 although the use of the back 212 may sufficiently inhibit such motion. The base 214 may be sufficiently flexible and the combination of the attaching mechanism 220 and the base 214 sufficiently forgiving such that the base 214 may adapt to one or more contours of the chair 226 in response to a person sitting on the base 214. As shown in FIGS. 9 and 10, the seating aid 210 may be slipped over the chair 226 by sliding the back 212 of the seating aid 210 over the back 224 of the chair 226 in a direction 270 such that the opening 222 snugly receives the back 224 of the chair 226. The back 224 may comprise a material that is configured to stretch (e.g., Lycra®, Spandex®, etc.) to facilitate the back 224 being able to accommodate and snugly receive different sizes and/or shapes of backs of chairs. The seating aid 210 may comprise multiple materials, e.g., a fabric sheet with different portions of the fabric sheet comprising different fabric materials. Once the back 224 of the chair 226 is received such that the base 214 is in contact with a seat 240 of the chair 226, the attachment mechanism 220 may be used to pull the base taut and attach the seating aid 210 to the chair 226. A person may sit on the seating aid 210 in an aperture 242 provided between the lateral impediments 216, 218 and receive sensory input to help the person maintain desired seating position for extended periods of time.

The seating aid 210 (or other seating aid) may include one or more further features. For example, a pocket 260 may be attached or included on a rear side of the back 212, e.g., for storage (e.g., for books and/or other school materials). As another example, a lumbar support (e.g., made of foam or other appropriate material) may be included in a front portion of the back 212 (e.g., in a front pocket of the back 212, or attached to a front wall of the back 212, possibly inside the opening 222). As another example, hanging mechanism 262 (e.g., a hook or a half of a hook-and-loop holder) may be attached to a rear of the back 212 such that an item may be hung to the back of the seating aid 210. For example, a name card or student chart may be hung from or otherwise attached to a rear of the seating aid 210.

Example implementations of the seating aid 210 (but using the attaching straps 24) for use with children have been made. The dimensions shown in the Table below for the seating aid 210 have been found to be useful for the ages of children indicated. These dimensions and ages are examples only, and the measurements are approximate. The dimensions (see FIG. 10) are for seat depth 250 (also known as lateral impediment height or displacement from the base 214), seat width 252 (i.e., separation of the lateral impediments 216, 218 with the base 214 taut), back height 254, and back width 256.

| Age of child | Seat Depth | Seat Width | Back Height | Back Width |
|---|---|---|---|---|
| 4-5 years | 10" | 12" | 10.5" | 11" |
| 6-9 years | 12" | 13.5" | 13" | 13" |
| 10+ years | 13" | 15" | 15" | 14.5" |

Other Considerations

Other examples and implementations are within the scope and spirit of the disclosure and appended claims.

The invention claimed is:

1. A device for use with a seat, the device comprising:

a first side guard;

a second side guard;

a separator coupled to the first side guard and the second side guard to provide a separation of the first side guard from the second side guard to laterally displace the second side guard from the first side guard;

an attachment mechanism connected to the separator, or connected to the first side guard and the second side guard, or connected to the separator, the first side guard, and the second side guard, the attachment mechanism being configured to releasably attach the device to the seat such that, when the device is attached to the seat, the first side guard provides a first lateral impediment along a first front-to-back distance of the seat and the second side guard provides a second lateral impediment along a second front-to-back distance of the seat;

wherein the attachment mechanism comprises:

a first connector shaped to define a first aperture to receive a first lateral edge of the seat, the first connector being configured and disposed relative to the separator to have the first aperture directed toward the second side guard when the device is mounted to the seat; and a second connector shaped to define a second aperture to receive a second lateral edge of the seat, the second connector being configured and disposed relative to the separator to have the second aperture directed toward the first side guard when the device is mounted to the seat;

wherein a combination of the separator and the attachment mechanism is configured to inhibit separation of the first side guard from the second side guard with the device attached to the seat by the attachment mechanism, the first connector being configured and disposed to resist outward lateral movement of the second side guard with the device mounted to the seat and the second connector being configured and disposed to resist outward lateral movement of the first side guard with the device mounted to the seat;

wherein each of the first side guard and the second side guard, with the device attached to the seat, will be disposed above a surface of the seat to interfere with a lateral movement of a respective leg of a user sitting on the seat; and wherein the device is configured such that, with the device attached to the seat, the device:

provides an aperture between the first side guard and the second side guard through which a person can sit directly on the seat; or comprises a flexible sheet between the first side guard and the second side guard.

2. The device of claim 1, wherein the separator comprises a flexible material attached to the first side guard and the second side guard.

3. The device of claim 2, wherein the attachment mechanism comprises:

a third connector shaped to receive the first lateral edge of the seat; and a fourth connector shaped to receive the second lateral edge of the seat;

wherein the first connector and the third connector are disposed at different positions relative to a first length of the first side guard, and the second connector and the fourth connector are disposed at different positions relative to a second length of the second side guard.

4. The device of claim 2, wherein each of the first side guard and the second side guard extend at a respective oblique angle relative to a front-to-back direction of the seat.

5. The device of claim 2, further comprising a slip-resistant material attached to the flexible material and configured to engage the seat to resist sliding movement of the flexible material relative to the seat.

6. The device of claim 1, wherein the first connector and the second connector are U-shaped clips each with at least one outward curving arm.

7. A seat cover comprising:

a first fabric sheet providing a seat portion of the seat cover;

a first lateral impediment attached to and disposed along a first length of the first fabric sheet, the first lateral impediment extending away from the first fabric sheet;

a second lateral impediment attached to and disposed along a second length of the first fabric sheet, the first length being laterally displaced from the second length;

at least one member attached to the first fabric sheet, or attached to the first lateral impediment and the second lateral impediment, or attached to the fabric sheet and the first lateral impediment and the second lateral impediment, and configured to engage a seat to resist lateral motion of first lateral impediment and the second lateral impediment relative to the seat; and a tubular back comprising a second fabric sheet and a third fabric sheet, the second fabric sheet providing a front wall of the tubular back and the third fabric sheet providing a back wall of the tubular back, the second fabric sheet being connected to the first fabric sheet adjacent to the first lateral impediment and the second lateral impediment, the second fabric sheet being connected to the third fabric sheet at multiple points along a length of the tubular back, the tubular back being configured to removably, slidably receive a back of a chair;

wherein the first lateral impediment and the second lateral impediment extend away from the fabric sheet and away from a top surface of the seat when the seat cover is fastened to the seat to receive a person on the first fabric sheet; and wherein the at least one member comprises a first pair of fabric straps and a second pair of fabric straps displaced from the first pair of fabric straps along a front-to-back distance of the seat cover.

8. The seat cover of claim 7, wherein the third fabric sheet of the tubular back and the first fabric sheet comprise different fabrics.

9. The seat cover of claim 8, wherein the third fabric sheet is configured to stretch more than the first fabric sheet.

10. The seat cover of claim 7, wherein the first lateral impediment and the second lateral impediment each comprise a resilient member disposed in a fabric tube.

11. The seat cover of claim 7, wherein each of the first lateral impediment and the second lateral impediment extends at a respective oblique angle relative to a front-to-back direction of the seat cover.

12. The seat cover of claim 7, wherein the at least one member comprises a slip-resistant material attached to a bottom surface of the first fabric sheet.

13. The seat cover of claim 7, wherein the at least one member comprises a plurality of U-shaped clips, each with at least one outward curving arm and each configured to receive a respective lateral edge of the seat.

* * * * *